US006881441B1

(12) United States Patent
Kobayashi et al.

(10) Patent No.: US 6,881,441 B1
(45) Date of Patent: Apr. 19, 2005

(54) METHOD FOR INTERMITTENTLY FORMING LAID LAYERS

(75) Inventors: Hideo Kobayashi, Tochigi (JP); Masaki Sakamoto, Tochigi (JP); Masahide Okumura, Tochigi (JP); Hironobu Kawajiri, Tochigi (JP)

(73) Assignee: Kao Corporation, Tokyo (JP)

( * ) Notice: Subject to any disclaimer, the term of this patent is extended or adjusted under 35 U.S.C. 154(b) by 503 days.

(21) Appl. No.: 09/869,643

(22) PCT Filed: Jun. 7, 2000

(86) PCT No.: PCT/JP00/03692

§ 371 (c)(1),
(2), (4) Date: Jul. 2, 2001

(87) PCT Pub. No.: WO00/76850

PCT Pub. Date: Dec. 21, 2000

(30) Foreign Application Priority Data

Jun. 10, 1999 (JP) ..... 11/163976

(51) Int. Cl.[7] ..... B05D 1/22; B05C 9/10

(52) U.S. Cl. ..... 427/185; 427/288; 118/32; 118/40

(58) Field of Search ..... 427/258, 271, 427/275, 277–278, 185, 288, 176, 358, 420; 118/32, 40, 42, 44; 493/223, 231, 244, 267

(56) References Cited

U.S. PATENT DOCUMENTS 2,598,264 A * 5/1952 Jones et al.
3,769,258 A * 10/1973 Bayer et al.
5,217,722 A * 6/1993 Ickinger et al.

FOREIGN PATENT DOCUMENTS

| | | | |
|---|---|---|---|
| EP | 1 229 106 | * | 8/2002 |
| FR | A2155515 | | 5/1973 |
| GB | A884194 | | 12/1961 |
| JP | 54-27083 | | 3/1979 |
| JP | 2003-71347 | * | 3/2003 |

* cited by examiner

*Primary Examiner*—Fred J. Parker
(74) *Attorney, Agent, or Firm*—Birch, Stewart, Kolasch & Birch, LLP

(57) ABSTRACT

An intermittently laying method for intermittently forming laid layers (14) comprising a fluidized substance (13) laid thereon on a surface of a sheet-like member (12) moving in one direction, in the moving direction, the method comprising steps of: folding a part of the sheet-like member (12) corresponding to a non-laid portion (15) between adjacent laid portions inwardly towards a back surface side of the sheet-like member (12) on an upstream side of a coating head (16) for laying the fluidized substance (13) on the sheet-like member (12) thereby forming a continuous surface-to-be-laid (30) on a surface side; continuously supplying the fluidized substance (13) from the laying means to the surface-to-be-laid thereby forming the laid layer (14); bringing back the inwardly folded non-laid portion (15) so as to be flush with the surface-to-be-laid (30) on a downstream side of the coating head (16); and intermittently interposing the non-laid portion (15) between continuously laid adjacent laid layers (14).

5 Claims, 4 Drawing Sheets

METHOD FOR INTERMITTENTLY FORMING LAID LAYERS

This application is the national phase under 35 U.S.C. § 371 of PCT International Application No. PCT/JP00/03692 which has an International filing date of Jun. 7, 2000, which designated the United States of America and was published in English.

TECHNICAL FIELD

This invention relates to an intermittently laying method and an intermittently laying apparatus in which laid layers formed of a fluidized substance are intermittently formed on a surface of a sheet-like member (basefilm).

BACKGROUND ART

As a method for producing, on a mass production basis, products consisting of rectangular flat bags with fluidized substance contained therein, the bags being formed by scaling peripheral edge portions of a pair of top and back sheet-like members, there can be contemplated a method, as shown in FIG. 4, in which laid layers 43 formed of a fluidized substance are longitudinally and laterally arranged on an upper surface of a belt-like back surface sheet 42 which is moved in one direction by a conveyor 41, while interposing non-laid portions 44, a top sheet 45 is disposed in such a manner as to cover the laid layers 43, thereafter, the back and top sheets 42, 45 are scaled together at the non-laid portions 44 and then, the sealed portions are properly cut and divided As a method for disposing laid layers 43 formed of a fluidized substance on a band-like back surface sheet 42, which is flowingly moved in one direction, while interposing non-laid portions in the moving direction X, there can be contemplated, for example, a method for intermittently providing the non-laid portions 44 by repeating the supply and stop of the fluidized substance made by a coating head 46 at every predetermined time interval. However, this method has such inconveniences that controlling of the coating head 46 becomes complicated, the non-laid portion 44 is difficult to be interposed with high degree of precision in accordance with the moving speed of the back surface sheet 42, and production capability is not high.

It is an object of the present invention to provide an intermittently laying method and an intermittently laying apparatus in which laid layers formed of fluidized substance can easily be formed on a surface of a sheet-like member moving in one direction while intermittently interposing non-laid portions in the moving direction with high degree of accuracy and in which production capability can be enhanced.

DISCLOSURE OF INVENTION

The present invention has achieved the above object by providing an intermittently laying method for intermittently forming laid layers comprising a fluidized substance laid thereon in the moving direction, on a surface of a sheet-like member moving in one direction, the method comprising steps of:

folding a part of the sheet-like member corresponding to a non-laid portion between adjacent laid portions inwardly towards a back surface side of the sheet-like member on an upstream side of laying means for laying the fluidized substance on the sheet-like member thereby forming a continuous surface-to-be-laid on a surface side;

continuously supplying the fluidized substance from the laying means to the surface-to-be-laid thereby forming the laid layer;

bringing back the inwardly folded non-laid portion of the sheet-lie member so as to be flush with the surface-to-be-laid on a downstream side of the laying means; and intermittently interposing the non-laid portion between continuously laid the adjacent laid layers formed of the fluidized substance.

Also, the present invention has achieved the above object by providing an intermittently laying apparatus for intermittently forming laid layers comprising a fluidized substance laid thereon on a surface of a sheet-like member moving in one direction, in the moving direction, the apparatus comprising:

laying means for laying the fluidized substance on the sheet-like member, folding means disposed on an upstream side of the laying means and adapted to fold a part of the sheet-like member corresponding to a non-laid portion between adjacent laid portions inwardly towards a back surface side of the sheet-like member thereby forming a continuous surface-to-be-laid on a surface side; and unfolding means disposed on a downstream side of the laying means and adapted to bring back the inwardly folded non-laid portion of the sheet-like member, so as to be flush with the surface-to-be-laid.

The above "sheet-like member (basefilm)" is a thin and flexible member which can easily be bent, but which can be restored to its original state after the bending state is released, preferably with such features that no trace of bending remains. For example, film, paper, cloth, woven fabric, nonwoven fabric and the like can be used as the sheet-like member.

As means for moving the sheet-like member in one direction, there can be used a continuous transferring device such as, for example, a belt conveyor and a top plate chain of either the belt or block type which can continuously transfer the supplied items loaded thereon.

The above-mentioned term "fluidized substance" includes those having such fluidity as being able to be supplied to the surface of the sheet-lice member and shape retainability capable of retaining its shape when laid in the form of layer. For example, it may include not only paste-like or half-fluidized substance having viscosity but also powder-like or particle-like substance.

The above-mentioned term "laying (including it's conjugation)" means that the fluidized substance is disposed on the surface of the sheet-like member in the form of layer by supplying the fluidized substance to the sheet-like member through laying means. It includes such concepts as to coat the fluidized substance onto the surface of the sheet-like member, to provide the fluidized substance, which has been formed by extrusion molding or roll molding, in such a manner as to cover the upper surface of the sheet-like member, to spray the fluidized substance onto the upper surface of the sheet-like member and so on.

Figure 1:
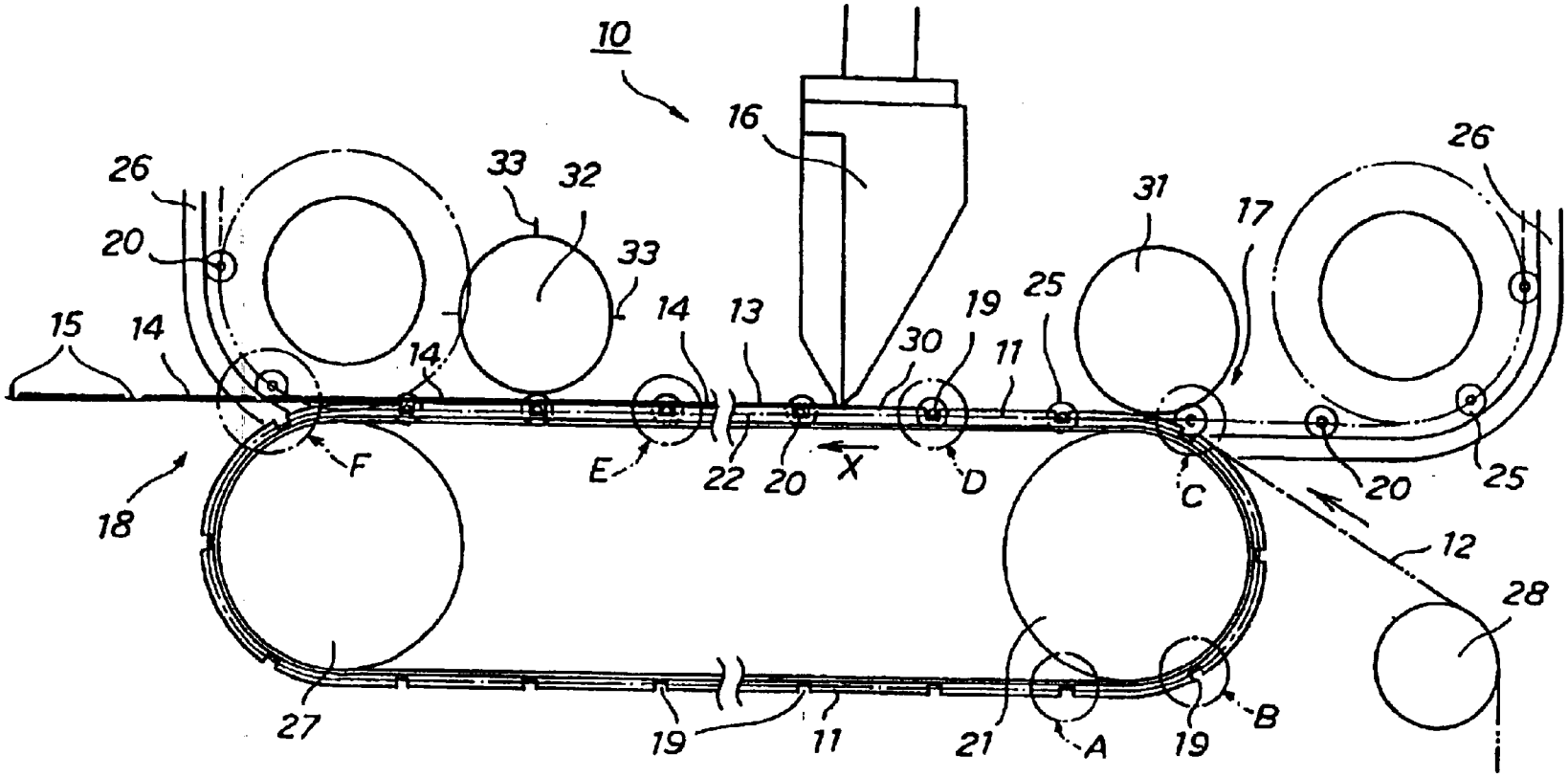
FIG. 1 is a side view for explaining a construction of an intermittently laying apparatus according to one embodiment of the present invention.
Figure 2A:
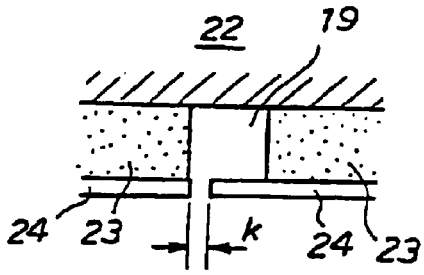
FIG. 2(*a*), FIG. 2(*b*), FIG. 2(*c*), FIG. 2(*d*) and FIG. 2(*e*) are explanatory views showing several states in which a sheet-like member is folded inwardly towards a back surface side, FIG. 2(*a*) is an enlarged view of an A portion of FIG.
Figure 2B:
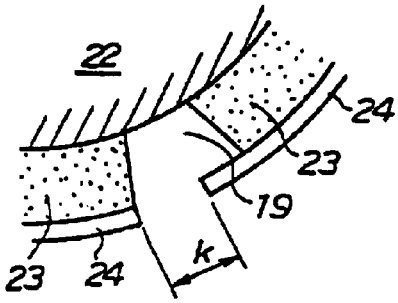
Figure 2C:
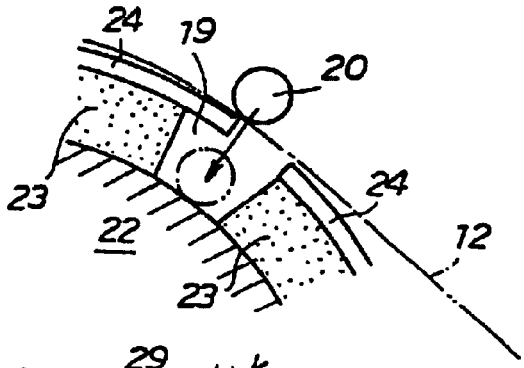
Figure 2D:
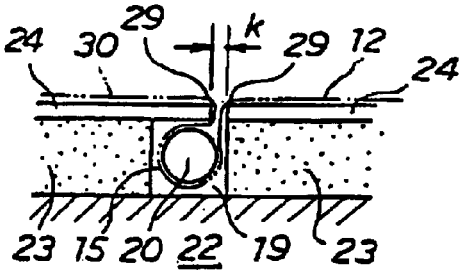
Figure 2E:
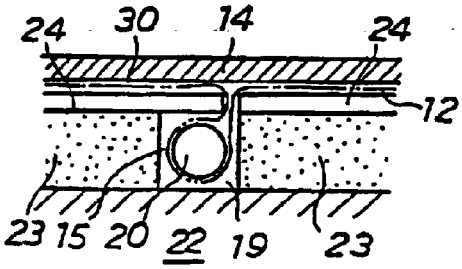
Figure 3:
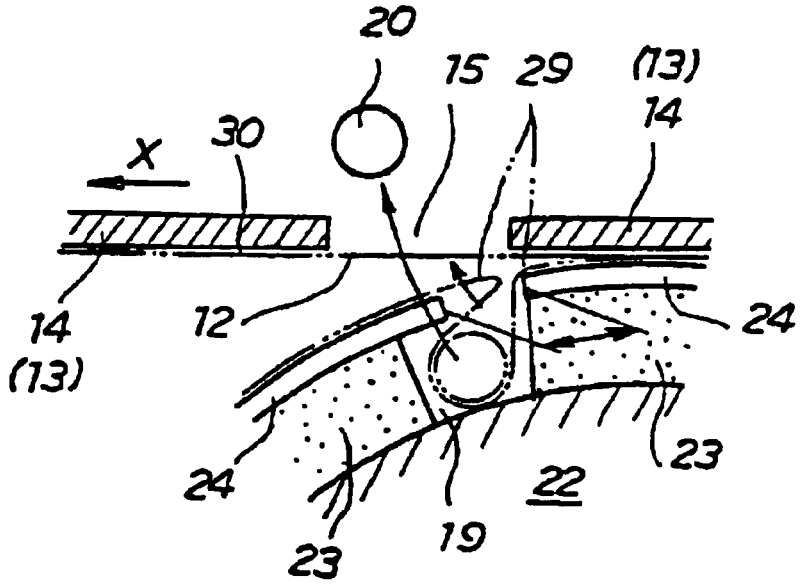
Figure 4:
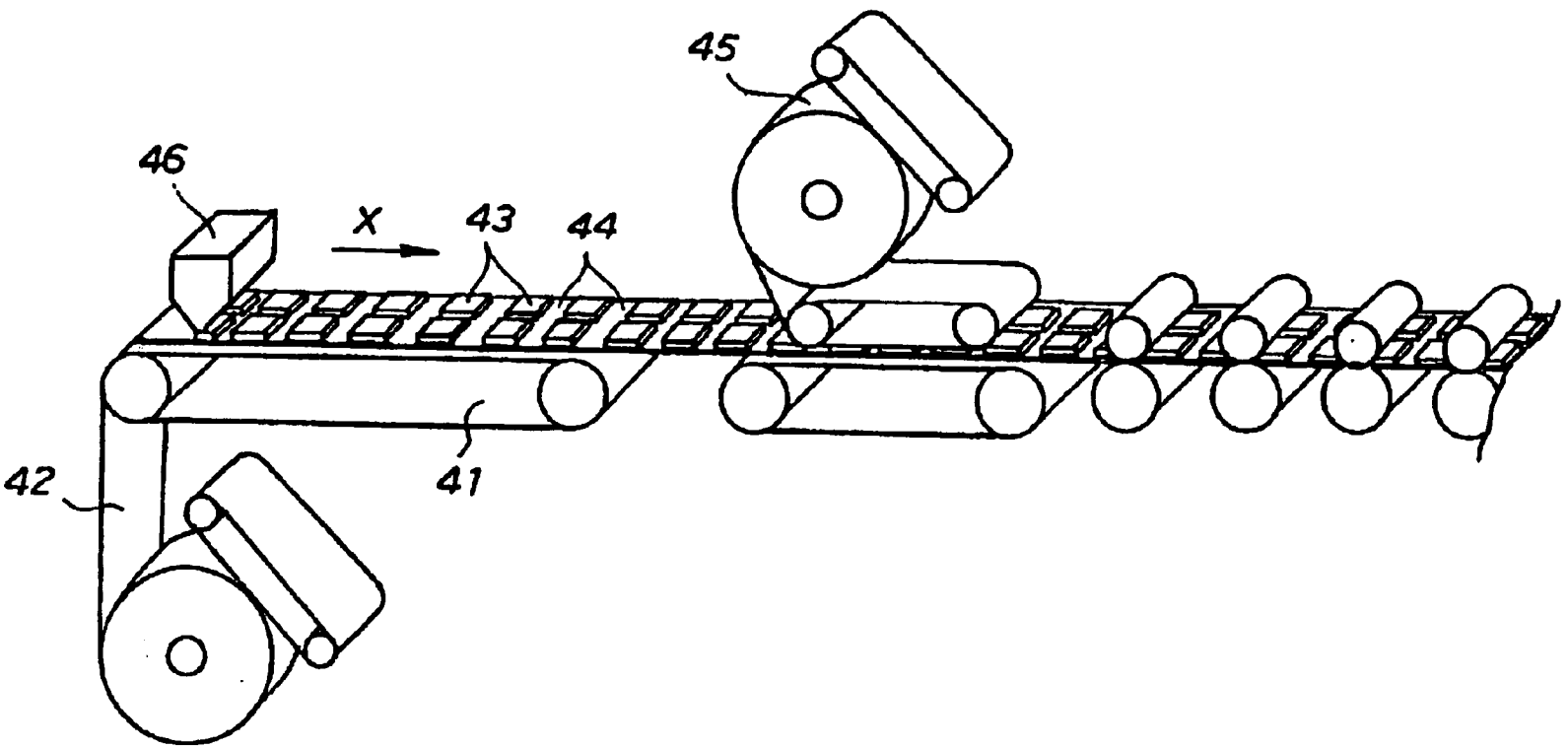

1, FIG. 2(*b*) is an enlarged view of a B portion of FIG. 1, FIG. 2(*c*) is an enlarged view of a C portion of FIG. 1, FIG. 2(*d*) is an enlarged view of a D portion of FIG. 1 and FIG. 2(*e*) is an enlarged view of an E portion of FIG. 1;

FIG. 3 is an enlarged view of an F portion of FIG. 1 for explaining a state in which the sheet-like member is unfolded; and FIG. 4 is an explanatory view for exemplifying a conventional method for manufacturing a product in which fluidized substances are received in a rectangular flat bag fabricated by sealing peripheral edge portions of a pair of sheet-like members.

BEST MODE FOR CARRYING OUT THE INVENTION

One preferred embodiment of the present invention will be described. An intermittently laying method and an intermittently laying apparatus according to the present invention are employed at the time when a sheet-like detergent package obtained by receiving detergent in the form of a dough as a fluidized substance in a flat bag having a rectangular configuration in a plan view which flat bag is formed by sealing peripheral edge portions of a pair of top and back sheets is produced on a mass production basis. A coated layer (laid layer) 14 formed of dough-like detergent 13 is intermittently formed on a surface of a belt-like back surface sheet 12 which is continuously supplied in one direction and is moved, as if flowing, by a conveyor 11 in the moving direction X, while interposing non-coated portions (non-laid portions), using an intermittently laying apparatus of FIG. 1. The term "dough" herein used refers to a kneaded mixture obtained by mixing and kneading a powder composition with a substance having fluidity such as paste, gel or the like as disclosed in Japanese Patent Laid-Open Publication No. Hei 10-204499. The substance having fluidity includes those which are fluidized by heating or being stressed.

After a top sheet is disposed on a surface of each coated layer 14 while interposing the non-laid portions 15, in the same manner as shown in FIG. 4 in the next process, the top and back sheets are sealed at the non-coated portions 15 and then, the sealed portion is properly cut and divided to thereby obtain a sheet-like detergent package which is a rectangular flat bag consisting of a pair of top and back sheets and containing dough-lice detergent therein.

The dough-like detergent 13 of this embodiment is a paste-like detergent having fluidity and plasticity which can be coated onto the surface of the back surface sheet 12 through the coating head 16 serving as laying means. The dough-like detergent 13 has viscosity and such shape-retainability that it is not collapsed nor flowed out and it can be held in the coated state which is in the form of a layer. The back surface sheet 12 and the top surface sheet are fabricated of a fiber sheet composed of for example, polyvinyl alcohol fiber or various kinds of water soluble films. Accordingly, when a predetermined number of the sheet-like detergent packages obtained by cutting and individually dividing the sealed portions are put into a washing machine at a time of washing with the use of a washing machine, the top and back sheets covering the dough-like detergent 13 are dissolved rapidly to facilitate easy dissolving of the packaged dough-like detergent in the washing water.

The intermittently laying apparatus 10 of this embodiment includes the coating head 16 for coating the dough-like detergent 13 onto the back surface sheet 12, folding means 17 disposed on an upstream side of the coating head 16 and adapted to fold the back surface sheet 12 inwardly and unfolding means 18 disposed on a downstream side of the coating head 16.

The folding means 17 includes a plurality of pin insert grooves 19 each serving as a push-in groove formed in the surface of the conveyor 11 at a predetermined interval (for example, 70 mm) in a moving direction X of the back surface sheet 12 which is moved by the conveyor 11 and extending in a direction perpendicular to the moving direction X, a plurality of pin members 20 capable of movement at the same speed as the pin insert groove 19 in the moving direction X and disposed such that the height of the center axis is brought to be generally equal to the center height of the pin insert groove 19 when it moves in the moving direction X and each serving as an insert member inserted along the pin insert groove 19, and an upstream side roll member 21 for making a change of direction of the conveyor 11 and guides it in the moving direction X. The function of the push-in grooves can be constituted by, for example, arranging two narrow rods side by side, as far as there are two spaced edge portions for forming the push-in grooves for supporting the sheets and a space defined between the two edge portions of the push-in grooves. The edge portions of the push-in grooves are approached to each other to make the surfaces of the sheets substantially continuous when the fluidized substance is laid as later described. The insert members serve to push a part of the sheet into between two spaced apart edge portions.

The pin insert groove 19 is, as shown in FIG. 2(*a*), formed in a surface of a belt body 22 of the conveyor 11 by arranging sponge plates 23 made of urethane having a thickness of 5 mm, for example, in a closely contacted relation with a gap of about 5 mm, for example, formed between the adjacent sponge plates 23 in such a manner as to have a width of 5 mm and a depth of 5 mm, for example, depending on the size dimension (of the gap. The surface of each sponge plate 23 is covered with a protective film plate 24 composed of polyethylene terephthalate (PET) film having a thickness of 0.2 mm, for example, such that one end portion of the protective film plate 24 is expanded, as an edge portion, into a surface opening portion of the pin insert groove 19, thereby providing an opening width k of about 0.2 mm of the pin insert groove 19.

The sponge plate 23 has a soft material quality good enough to restrain its peel-off from the belt body 22 at the time of making a change of direction on the upstream side roll member 21. The protective film plate 24 has such resiliency that it can be deformed to the extent able to be inserted in the pin member 20 of the pin insert groove 19.

The pin member 20 is a round steel having a diameter of 3 mm, for example. The pin member 20 is provided on opposite ends thereof with a bearing 25 (see FIG. 1). On opposite sides with the conveyor 11 disposed therebetween, there are provided a pair of pin guide rails 26 which constitute a pin transfer system. By rollingly moving the bearings 25 along the pin guide rails 26, the pin members 20 can be moved in the moving direction X at the same speed as the conveyor 11 while maintaining the height of the center axis generally equal to the height of the center of the pin insert groove 19. The pin members 20 are arranged along the pin guide rails 26 at the same pitch (for example, 70 mm) as the pin insertion grooves 19. Accordingly, a plurality of the pin members 20 can be inserted in the respective pin insert grooves 19 in the moving direction X simultaneously.

The upstream side roll member 21 is a cylindrical member having a diameter of 125 mm, for example. The conveyor 11 is disposed between the upstream side roll member 21 and a downstream side roll member 27, as later described, and the conveyor 11 is turned endlessly at a predetermined speed by driving force of a driving motor. As shown in FIG. 2(*b*), when the conveyor 11 moving below is caused to make a change of direction upwardly, the upstream side roll member 21 enlarges the opening width k of the pin insert groove 19, i.e., the edges of the push-in groove are caused to move away from each other depending on the curvature of the outer peripheral surface. In contrast, when the conveyor 11 is caused to move in the moving direction X from the outer peripheral surface, the opening width k of the pin insert groove 19 is reduced again so that the edges are caused to move towards each other (see FIG. 2(*d*)).

According to this embodiment, when the pin insert groove 19 located on the outer peripheral surface of the upstream side roll member 21 passes the outer peripheral surface so that the opening width k is brought from the enlarged state (see FIG. 2(*b*)) to the reduced state (see FIG. 2(*d*)), the pin member 20 is inserted in the pin insert groove 19 against resiliency of the expanded protective film plate 24 while sandwichingly retaining the back surface sheet 12 which is continuously fed out from a sheet feed roll 28 (see FIG. 1). By doing so, a part of the back surface sheet member 12 corresponding to the non-coated portion 15 is folded inwardly towards the back surface side of the back surface sheet member 12.

When the back surface sheet 12 is folded into the pin insert groove 19 through the pin member 20, the enlarged opening width k between a distal end of the protective film plate 24 and the adjacent sponge plate 23 is reduced again as the pin insert groove 19 located at the outer peripheral surface of the upstream side roll member 21 moves in the moving direction X (see FIG. 2(*d*)). As a consequence, the edge portions of the pair of upstream side and downstream side of push-in grooves 19 are moved towards each other, so that the folding edge portions 29 of the back surface sheets 12 are moved towards each other thereby forming a continuous surface-to-be-coated (surface-to-be-laid) for continuously coating the dough-like detergent 13 thereon from the coating head 16. As shown in FIGS. 1 and 2(*e*), this surface-to-be-coated 30 is continuously coated with the dough-like detergent 13 coming from the coating head 16.

According to this embodiment, the pin members 20 are inserted in the pin insert grooves 19 in the state that the height of the center axis of each pin member 20 is brought to be equal to the center height of each pin insert groove 19. By properly adjusting the heightwise or crosswise position of the pin member 20 in the pin insert groove 19, the folding amount of the back surface sheet 12 sandwichingly held by the pin members 20 can be increased/decreased. Therefore, by doing so, the width of the non-coated portion 25, described later, can easily be adjusted. Such positional adjustment of the pin member 20 in the pin insert groove 19 can easily be made by properly controlling the relative position between the upstream side and downstream side roll members 21, 27 with the conveyor 11 disposed therebetween and pin guide rails 26 for guiding the bearing 25 mounted on the pin member 20. Also, the width of the non-coated portion 15 can easily be adjusted by varying the diameter of the pin member 20 to increase/decrease the folding amount of the back surface sheet 12.

According to this embodiment, a pin push-in roll 31 may be disposed above the upstream side roll member 21 in such a manner as to contact the conveyor passing an upper end portion of the upstream side roll member 21. The back surface sheet 12 can smoothly be folded inwardly by pressing the pin member 20 with the pin push-in roll 31 thereby causing the pin member 20 to be inserted in the pin insert groove 19.

On the other hand, according to this embodiment, the unfolding means 18 includes the downstream side roll member 27 for making a change of direction of the back surface sheet 12 from the moving direction X to the downward direction and tension applying means (not shown) for applying a pulling tension so as to pull the back surface sheet 12 in the moving direction X on a more downstream side than the downstream side roll member 27.

The downstream side roll member 27 is a cylindrical member, like the upstream side roll member 21, having a diameter of 125 mm, for example. When the conveyor 11 moving in the moving direction X is caused to make a change of direction downwardly, the downstream side roll member 27 enlarges the opening width k of the pin insert groove 19 as shown in FIG. 3 by the curvature of the outer peripheral surface. And the pin member 20, which is continuously moving along the moving direction X is taken out of the pin insert groove 19 so that the folded state of the back surface sheet 12 located at the non-coated portion 15 is released.

The tension applying means includes, among others, a feed roller (not shown) for feeding the back surface sheet 12 with the dough-like detergent 13 to the next sealing process, for example. Since the feeding speed is faster than the moving speed of the back surface sheet 12 which is moved in the moving direction X by the conveyor 11, the back surface sheet 12 is pulled towards the downstream side in the moving direction X to thereby cause the fold-in edge portions 29, 29 of the back surface sheet 12 to be moved away from each other so that the non-coated portion 15 of the back surface sheet 12 is brought back so as to be flush with the surface-to-be-coated 30 (see FIG. 3).

According to this embodiment, on the upstream side of the downstream side roll member 27, there is a provision of a cutting roll 32 serving as cutting means which is located above the coated layer 14 formed by continuously coating the top surface of the back surface sheet 12. The cutting roll 32 is a cylindrical member of such a size dimension that the ¼ length of its circumference is equal to the pitch length of the pin insert groove 19. The cutting roll 32 has cutters 33 projecting from the positions obtained by dividing the circumference into four. Each cutter 33 is located immediately above the pin insert groove 19 with the non-coated portion 15 of the back surface sheet 12 folded therein. The cutter 33 is cut into the coated layer 14 formed by continuously coating the dough-like detergent 13 onto the coated surface 30 at the location immediately above the pin insert groove 19, so that a cut line is formed therein. The cutting roll 32 is controlled such that the speed of rotation at its peripheral surface is equal to the moving speed of the conveyor 11 in the moving direction X and the four cutters 33 are sequentially cut into the coated layer 14 immediately above the pin insert grooves 19 which are arranged at a predetermined pitch, thereby forming the cut lines therein.

By preliminarily forming the cut lines in the continuous coated layer 14 on the upstream side of the downstream side roll member 27, even the dough-like detergent 13 having viscosity can easily be cut away towards opposite sides through the cut lines when the fold-in edge portions 29 of the back surface sheets 12 are moved away from each other while taking out the pin members 20 from the pin insert grooves 19. Therefore, it can easily be avoided that the dough-like detergent 13 is exposed to the non-coated portion and that the dough-like detergent 13 is adhered to the pin member 20 to soil it when the pin member 20 is taken out.

Cutter soil removing means (not shown) for cleaning the cutter 33 using a brush, a woven fabric, a nonwoven fabric, air or the like after the dough-like detergent 13 is cut, is disposed adjacent the cutting roll 32. Also, pin soil removing means (not shown) for cleaning the pin member 20 taken out of the pin insert groove 19 using a brush a nonwoven fabric, air or the like, is disposed adjacent the pin guide rails 26 on the more downstream side than the fold-in releasing means 18.

As another means for preliminarily forming a cut line in the continuous coated layer 14 at the location immediately above the pin insert groove 19 with the non-coated portion 15 folded therein, there are the following methods. Firstly, there is a reciprocating type cutting method in which the cut line is formed by moving the cutter up and down. There is also an equal speed reciprocating type cutting method in which the cut-in state of the cutter with respect to the coated layer 14 is maintained for a predetermined time together with the moving speed of the coated layer 14 after the cutter is cut into the coated layer 14, so that a cut line can positively be formed. There is also a traverse type cutting method in which a cut line can be formed in the coated layer 14 by moving a cutter in the widthwise direction of the coated layer 14.

According to this embodiment, by using the intermittently laying apparatus 10 having the above-mentioned construction, the coated layer 14 formed of the dough-like detergent 13 can easily be formed on the surface of the belt-like back surface sheet 12 continuously fed in the moving direction X and moved by the conveyor 11, while intermittently interposing the non-coated portions 15 in the moving direction X That is to say, first on the upstream side of the coating head 16, the back surface sheet 12 located at the non-coated portion 15 is folded inwardly towards the back surface side of the back surface sheet 12 while inserting the pin member 20 in the pin insert groove 19, and the continuous surface-to-be-coated 30 is formed on the top surface side of the back surface sheet 12. Then, after the dough-like detergent 13 is continuously fed to the surface-to-be-coated 30 from the coating head 16 to form the coated layer 14 thereon, the inwardly folded non-coated portion 15 of the back surface sheet 12 is brought back so as to be flush with the coated surface 30 on the downstream side of the coating head 16, so that the non-coated portions 15 are intermittently interposed between the adjacent coated layers 14 formed of the continuously laid dough-like detergent 13.

One pair of the coating heads 16 are disposed in adjacent relation in a direction orthogonal to the moving direction X and the dough-like detergent 13 are coated on the back surface sheet 12 in two rows. By arranging the pair of coating heads 16 at a predetermined interval, a longitudinal non-coated portion 15 can easily formed between the two rows of coated layers 14 along the moving direction X. By this, the coated layers are arranged in two rows on the back surface sheet 12, while longitudinally and laterally interposing the non-coated portions 15.

According to this embodiment, since the non-coated portions are intermittently interposed by repeating the folding and unfolding of the back surface sheet 12 along the flow of the back surface sheet 12 without a need of intermittently controlling the coating head 16 by repeating the supply and stop of the dough-like detergent made by the coating head 16 at every predetermined time interval and while maintaining the continuous supply of the dough-like detergent 13 made by the coating head 16, the coated layer 14 formed of the dough-like detergent 13 can easily be formed while intermittently interposing the non-coated portions in the moving direction X with a high degree of precision. Thus, production capability of the sheet-like detergent package can be enhanced.

It should be noted that the present invention should not be limited to the above embodiment and many changes and modifications can be made. For example, the present invention should not be limited to the dough-like detergent. Instead, the present invention can likewise be employed when other compositions such as semi-fluidized compositions, or compositions in the form of powder or particle are to be laid. Also, it is not absolutely necessary that the top surface side sheet-like member is disposed in such a manner as to cover the laid layer and the non-coated portions are sealed in the next process. In other words, those procedures in the next process may be employed only in accordance with necessity. A provision of the cutting means is not absolutely necessary, either. In addition, the folding means and unfolding means should not be limited to those of the above embodiment.

INDUSTRIAL APPLICABILITY

According to an intermittently laying method and an intermittently laying apparatus of the present invention, a laid layer formed of a fluidized substance can easily be formed on the surface of the sheet-like member while intermittently interposing non-laid portions in the moving direction with high degree of precision and thus production capability can be enhanced.

What is claimed is:

1. A method of forming an intermittent layer of a fluidized substance on a surface of a sheet member moving in one direction, comprising:

folding first parts of said moving sheet member inwardly, away from said surface, second parts of said sheet member being formed between said first parts and remaining on said surface adjacent to each other;

continuously supplying said fluidized substance from a laying means onto said surface of adjacent second parts of said sheet member forming a layer;

unfolding said first parts of said sheet member and returning said first parts to said surface, causing said layer to be separated into a plurality of layer sections, said first parts of said sheet member forming non-layer portions between said layer sections.

2. An apparatus for forming an intermittent layer of a fluidized substance on a surface of a sheet member moving in one direction, comprising:

folding means for folding first parts of said sheet member inwardly away from said surface, second parts of said sheet member being formed between said first parts, and remaining on said surface adjacent to each other;

laying means disposed downstream from said folding means for continuously laying said fluidized substance onto said surface of adjacent second parts of said sheet member; and unfolding means disposed downstream of said laying means for unfolding said first parts of said sheet member and returning said first parts to said surface, causing said layer to be separated into layer segments, said first parts forming non-layer portions between said layer segments.

3. The apparatus according to claim 2, further comprising cutting means disposed between said laying means and said unfolding means for cutting said layer of fluidized substance at locations above said inwardly folded first parts of said sheet member.

4. The apparatus according to claim 2, wherein said folding means includes a plurality of grooves extending in a direction transverse to said moving direction, and a plurality of insert members moving at the same speed as said grooves and inserted into said grooves by an upstream side roll member; and wherein said grooves have an enlarged opening width upstream of said upstream side roll member which is reduced as said grooves pass said upstream side roll member, and wherein said insert members are inserted into said grooves while holding said sheet member, so that said first parts of said sheet member are folded inwardly into said grooves.

5. The apparatus according to claim 4, wherein said folding means further includes a means for adjusting the width of said first portion of said sheet member by changing a folding amount of said sheet member held by said insert members, said folding amount being changed by adjusting the position of said insert members when being inserted into said grooves.

* * * * *